United States Patent [19]

Waskow

[11] 4,288,039

[45] Sep. 8, 1981

[54] SINGLE-ROLL CRUSHER

[75] Inventor: Eberhard Waskow, Minden, Fed. Rep. of Germany

[73] Assignee: Weserhütte Aktiengesellschaft, Fed. Rep. of Germany

[21] Appl. No.: 120,808

[22] Filed: Feb. 12, 1980

Related U.S. Application Data

[63] Continuation of Ser. No. 959,296, Nov. 9, 1978, abandoned.

[51] Int. Cl.[3] ..... B02C 1/08

[52] U.S. Cl. ..... 241/198 A; 241/204; 241/264; 241/289

[58] Field of Search ..... 241/198 A, 201, 203, 241/204, 205, 241, 264–269, 289

[56] References Cited

U.S. PATENT DOCUMENTS

| | | | |
|---|---|---|---|
| 1,409,869 | 3/1922 | Krider | 241/289 |
| 1,783,373 | 12/1930 | Borton | 241/198 A UX |
| 2,921,750 | 1/1960 | Picalarga | 241/267 |
| 3,503,563 | 3/1970 | Daly | 241/204 |

FOREIGN PATENT DOCUMENTS

| | | | |
|---|---|---|---|
| 691146 | 5/1940 | Fed. Rep. of Germany | 241/198 A |
| 1358565 | 3/1964 | France | 241/239 |
| 429473 | 5/1935 | United Kingdom | 241/198 A |

*Primary Examiner*—Howard N. Goldberg
*Attorney, Agent, or Firm*—James E. Bryan

[57] ABSTRACT

This invention relates to an improvement in a single-roll crusher having a housing, a roll body freely rotatably supported on an eccentrically rotatable drive shaft in said housing, at least one laterally mounted crushing beam pendularly suspended in the upper part of said housing and resting in the lower region thereof at approximately the height of the roll body axis, by means of a pressure bar, against a prestressed set of springs solidly integrated in the crusher housing in order to absorb the crushing force, the prestressing force also being adjustable when the set of springs is integrated and the gap adjustment at the exit of the crushing space is achieved by changing the spacer thickness between the pressure bar and a spring retainer, the improvement comprising bayonet lock means holding the prestressed set of springs in the crusher housing, the prongs and mating prongs of said bayonet lock means mutually engaging and releasing each other in assembly and disassembly, and key means pressing the support surfaces of the set of springs in the same direction as the crushing force on corresponding bearing surfaces in the crusher housing.

2 Claims, 3 Drawing Figures

SINGLE-ROLL CRUSHER

Figure 2:
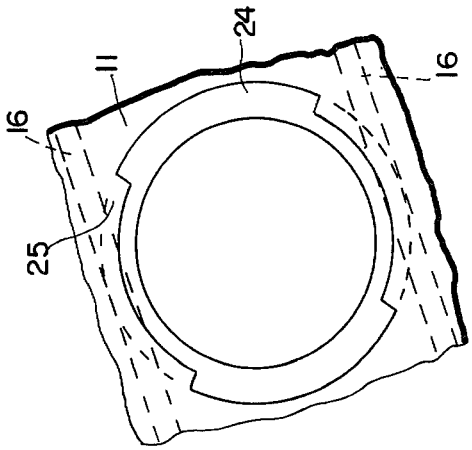

This is a continuation of application Ser. No. 959,296, filed Nov. 9, 1978, now abandoned.

This invention relates to a single-roll crusher with a roll body freely rotatably supported on an eccentrically rotatable drive shaft, and with one or two crushing beams mounted laterally thereto and suspended at the top in the crusher housing while resting at the lower end approximately at the height of the roll body axis against a prestressed set of springs solidly mounted in the crusher housing by means of a thrust bar for the purpose of absorbing the crushing force. The prestressing is adjustable even in the case of an integrated set of springs, and the gap setting in the exit of the crushing chamber is controlled by varying the thickness of the spacer between the thrust bar and a spring retainer.

The invention in particular relates to supporting the crusher beams of single-roll crushers operating in such a manner that a roll body supported in an eccentric and freely rotatable manner on a drive shaft is made to move circularly and reciprocatingly with respect to the crushing beams mounted to the side thereof.

The crushing beams are suspended in conventional pendular manner at their upper regions from the two longitudinal walls of the crusher housing. In their lower region, about at the height of the roll body axis, these crusher beams are retained by a prestressed set of springs mounted in the longitudinal and transverse walls of the crusher housing. Because the crushing beams are elastically supported in their lower parts, the impacts occurring in crushing are attenuated; furthermore the crushing beams may move out of the way if foreign bodies reach the crushing space between the roll body and the crusher beam together with the material to be crushed.

The set of springs most of the time is mounted in tipping manner in the longitudinal walls of the crusher housing, the axis of tipping being perpendicular to that of the set of springs (see for example German Pat. No. 1,257,004). In this case the crushing beams and the set of springs form a triple joint. This type of support is statically determinate, however mechanically very costly. Furthermore difficulties are encountered with setting the gap at the bottom at the exit from the crusher chamber.

On the other hand, it is more advantageous to solidly integrate the set of springs in the transverse walls of the crusher housing (see for example German Pat. No. 691,146). If then the movable spring retainer is designed in two parts in such a manner that it permits installing a spacer, gap adjustment is made possible in a simple manner, whereby the desired gap width always can be reset even for the continuous wear of the crusher walls or crushing jaws. In order to always achieve full contact between the crushing beam and the pressure piece of the spring retainer, an elastic tension member is appropriately mounted between the beam and the spring retainer, whereby the tension member between the beam and the housing then may be omitted.

Known designs of this type have the drawback that assembly and dismantling are difficult and time-consuming because the connections for the crushing forces to be transmitted require corresponding strength.

The purpose of the invention is to provide a suitable solution to the assembly or dismantling and the installation of the set of springs, whereby assembly or dismantling will require only a slight expenditure of time and whereby the crushing forces will be transmitted in suitable manner directly from the set of springs to the crusher housing.

Furthermore the setting of the prestressing force in the set of springs and the adjustment of the gap is made easier for the operating personnel.

The invention achieves this goal in that the prestressed set of springs is integrated in the crusher housing by means of bayonet locks of which the mating prongs mutually release in assembly and dismantling and in that fastening wedges press the bearing surfaces of the set of springs in the same direction as the crushing force on the corresponding bearing surfaces in the crusher housing.

When the support for the set of springs in the crusher housing is designed as a bayonet lock, this set can be assembled or dismantled in the shortest possible time. Because the fastening keys press these support surfaces of the set of springs directly on the corresponding support surface in the crusher housing, the crushing forces from that set of springs are transmitted directly to the housing and do not stress the keys whereby the keys cannot be deformed by the crushing forces. Appropriate keying is carried out using round keys or wedges, because they and their associated guides can be made most simply.

Precise setting of the prestressing force and of the gap width will be very easy for the operating personnel if a hydraulic power unit is used on the one hand to deliver the prestressing force for the set of springs and on the other hand to set the gap, where the unit is mounted at the crusher housing coaxially with the set of springs.

Figure 3:
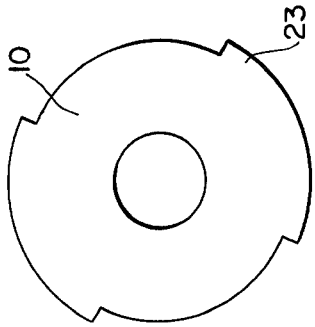
Figure 1:
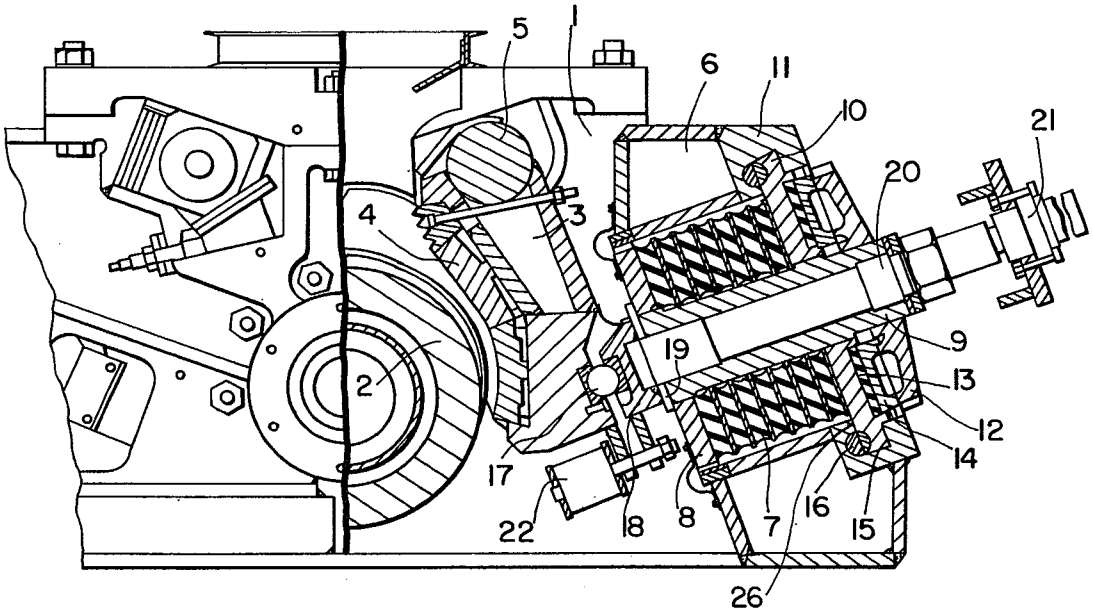

The invention will be further illustrated by reference to the accompanying drawings, in which:

FIG. 1 is a longitudinal view of a crusher and a longitudinal view in cross-section, FIG. 2 is a top view of the bayonet lock with prongs, viewed in the direction of the axis of the set of springs, and FIG. 3 is the support plate for the set of springs with prongs.

The reference numerals indicate the following:

1=longitudinal wall of the crusher housing
2=roll body
3=crushing beam
4=crushing jaw
5=support bolt for the crushing beam in the longitudinal walls
6=transverse wall of the crusher housing
7=steel retainers and rubber plates of the set of springs
8=spring retainer
9=guidance bushing
10=support plate for the set of springs with prong
11=base in the crusher housing for the set of springs with matching prongs
12=prestressing nut to apply prestressing force in the set of springs
13=damping plate
14=pressure piece between the damping plate and the prestressing nut
15=support surfaces between the set of springs and the crusher housing
16=semi-circular wedges or keys to force the set of springs against the crusher housing
17=pressure bar between the crushing beam and the set of springs 18=support plate for the pressure bar in the set of springs 19=spacer between the support plate and the spring retainer to set or adjust the crushing gap 20=central bolt solidly resting in the support plate 21=hydraulic power unit mounted to the crusher housing to displace the central bolt for the purpose of adjusting the prestressing force or the crushing gap 22=elastic tension member 23=prongs in the support plate of the set of springs 24=free passageway in the crusher housing for the prongs of the support plate of the set of springs 25=matching prongs in the crusher housing to support the prongs of the support plate.

The roll body 2 is eccentrically and freely rotatably mounted on a drive shaft and when the latter is rotated, the roll body is set into circularly reciprocating motions with respect to the laterally mounted crushing beams 3. These crushing beams are suspended in their upper portions by means of the support bolts 5 in the longitudinal walls of crusher housing 1. The set of springs is composed of the steel retainers and rubber plates 7, the spring retainers 8 and the guide bushing 9 solidly connected therewith, and of the support plate 10 with the prongs 23. The prestressing nut 12 is used to apply the prestressing force in the set of springs. The damping plate 13 attenuates impacts. A pressure piece 14 is mounted between the damping plate and the prestressing nut.

The set of springs rests in a stationary manner in the transverse wall 6 of the crusher housing, with keys, preferably semicircular keys 16 seated in the stop surface 26 forcing the support plate 10 with its prongs 23 against the mating prongs 25 in the base 11 in the crusher housing.

The spacers 19 to adjust the crushing gap can be inserted between the support plate 18 for the pressure bar 17 and the spring retainer 8, i.e., between the crushing beam and the set of springs. The set of springs is maintained at a predetermined prestressing force by the central bolt 20. The elastic tension member 22 ensures that the crushing beams rest by means of their pressure bar against the set of springs even when the crusher is empty. The hydraulic power unit 21 mounted at the transverse wall in the crusher housing allows pulling or pushing the central bolt to adjust the prestressing force or the crusher gap.

Because the assembly or disassembly of the set of springs, i.e. the integration of the set of springs in the transverse wall of the crusher housing, is implemented by a bayonet lock, such assembly or disassembly of a set of springs can be carried out in the shortest time without difficulty.

To dismantle the set of springs, the semi-circular keys 16 are removed and the tightening nut resting against the prestressing nut 12 is removed. Then, the set of springs is rotated by 90° so that the prongs of the support plate 10 are located in the clear passageway 24 in the crusher housing. The springs are then pulled through the opening, in the base 11 in the crusher housing, for the set of springs. The installation of a replacement set of springs is effected in the inverse sequence.

By means of the hydraulic power unit, it becomes feasible to set the spring prestressing force and the gap width without manual exertion, and to adapt these magnitudes to the operational conditions of the crusher or of the material to be crushed and to the wear of the crushing plates.

It will be obvious to those skilled in the art that many modifications may be made within the scope of the present invention without departing from the spirit thereof, and the invention includes all such modifications.

What is claimed is:

1. In a single-roll crusher having a housing, a roll body freely rotatably supported on an eccentrically rotatable drive shaft in said housing, at least one laterally mounted crushing beam pendularly suspended in the upper part of said housing and being positioned at approximately the height of the roll body axis by means of a clamping bolt against a prestressed set of springs including a plurality of springs clamped between a front spring seat and a rear support disc, the set of springs, in turn, being supported by means of the support disc against said housing, whereby when crushing forces acting on said prestressed set of springs exceed a prestressing force, the springs are further compressed and said clamping bolt and said front spring seat are displaced in said housing away from said crushing beam, the improvement comprising base means on the crusher housing adapted to support said rear support disc, said base means having an aperture therein through which said set of springs is adapted to pass, a stop surface, in said base means, facing away from said crushing beam, prong means, facing each other, in said base means, and opposed prong means on said rear support disc, whereby the prestressed set of springs can be locked in the axial direction thereof by interengaging, in the manner of a bayonet lock, the prong means in said base means with the opposed prong means on said rear support disc.

2. A single-roll crusher according to claim 1 including key means with a half round cross-section adapted to be forced between said stop surface in said base means and said opposed prong means on said rear support disc.

* * * * *